US007900785B2

(12) United States Patent
King et al.

(10) Patent No.: US 7,900,785 B2
(45) Date of Patent: Mar. 8, 2011

(54) TAPER UNDER TAPERED PLATE TO INCREASE SIDE FORCE ON THE MOVABLE PLATE

(75) Inventors: Dennis W. King, Blue Island, IL (US); Howard Sommerfeld, Oak Forest, IL (US)

(73) Assignee: WABTEC Holding Corp., Wilmerding, PA (US)

( * ) Notice: Subject to any disclaimer, the term of this patent is extended or adjusted under 35 U.S.C. 154(b) by 337 days.

(21) Appl. No.: 12/152,036

(22) Filed: May 12, 2008

(65) Prior Publication Data

US 2008/0264890 A1 Oct. 30, 2008

Related U.S. Application Data

(63) Continuation-in-part of application No. 11/071,004, filed on Mar. 3, 2005, now abandoned.

(60) Provisional application No. 60/561,050, filed on Apr. 8, 2004.

(51) Int. Cl.
*B61G 9/00* (2006.01)

(52) U.S. Cl. ..... 213/32 R; 213/22; 213/33

(58) Field of Classification Search ..... 213/22, 213/23, 24, 31, 32 R, 33, 34, 32 A, 32 C, 213/36, 37
See application file for complete search history.

(56) References Cited

U.S. PATENT DOCUMENTS 1,835,282 A * 12/1931 Cotton ..... 213/33
2,814,392 A * 11/1957 Campbell ..... 213/33
2,916,163 A * 12/1959 Campbell ..... 213/33
3,178,036 A * 4/1965 Cardwell ..... 213/33
3,447,693 A 6/1969 Cardwell
4,645,187 A 2/1987 Kanjo et al.

* cited by examiner

*Primary Examiner* — Mark T Le
(74) *Attorney, Agent, or Firm* — James Ray & Assoc

(57) ABSTRACT

Draft gear assembly includes an angled or tapered bottom surface on a tapered plate intermediate of the inner and outer friction surfaces thereof and further includes a complimentary mating angled or tapered surface provided on a built-up portion on a third horizontal rib of a housing and positioned in abutting engagement with the angled or tapered bottom surface on the tapered plate. Providing the mating angled or tapered surfaces increases the side force on movable plates during application of a buffing shock to the draft gear assembly, thus increasing the capacity and resistance of the draft gear assembly to closure.

15 Claims, 4 Drawing Sheets

TAPER UNDER TAPERED PLATE TO INCREASE SIDE FORCE ON THE MOVABLE PLATE

CROSS-REFERENCES TO RELATED APPLICATIONS

This application is a continuation-in-part of a prior non-provisional application Ser. No. 11/071,004 filed Mar. 3, 2005, now abandoned, which claims the benefit of U.S. Provisional Application No. 60/561,050 filed Apr. 8, 2004.

FIELD OF THE INVENTION

The present invention relates, in general, to draft gear assemblies for use in cushioning both buff and draft shocks normally encountered by railway rolling stock during make-up and operation of a train consist on a track structure and, more particularly, the present invention relates to a draft gear assembly having a tapered plate wherein a portion of the bottom surface which contacts a build-up portion on the third horizontal rib of the housing is angled to increase the side force on the movable plate thus increases the draft gear assembly's resistance to closure and increases the capacity of the draft gear assembly.

BACKGROUND OF THE INVENTION

Draft gear assemblies which utilize friction-type clutch mechanisms to absorb heat energy generated during service have been in widespread use in the railroad industry for many years to absorb both buff and draft shocks applied to the railway rolling stock. Many of such draft gear assemblies which were in use, prior to the present invention, are taught in U.S. Pat. Nos. 2,916,163; 3,178,036; 3,447,693; and 4,645,187. Each of the above-identified patents is owned by the assignee of the present invention. The teachings of each of these patents are all incorporated into the present application by reference thereto.

These draft gear assemblies are designed to receive coupler forces and dissipate them without damage to the car structure and lading. The assemblies are disposed within an elongated opening located in the center sill member of the railway car along the longitudinal axis thereof and behind the shank, or innermost end, of the railway car's coupling mechanism. In this position, these friction clutch type draft gear assemblies will absorb at least a relatively large portion of both the buff and draft forces generated during service. Such buff and draft forces encountered by such railway cars are usually being applied in an alternating manner to the center sill member during normal car operation on the track.

It is well recognized in the art that these draft gear assemblies must be provided with the capability of maintaining at least a certain minimum shock absorbing capacity both during making up a train consist and in-track service. Such minimum capacity has been specified by the Association of American Railroads (AAR) and is defined in the standards issued by the AAR. For example, friction clutch type draft gear assemblies have a specified absolute minimum capacity rating of at least 36,000 foot pounds. Any draft gear assembly with a capacity rating which is determined to be below 36,000 pounds will not receive approval from the AAR for service on any railroad car which may be used in interchange.

It is, likewise, important to note that the heat energy absorbing action of the friction clutch mechanism must enable this minimum capacity rating to be readily achieved without exceeding a specified maximum 500,000-pound reaction force, or pressure, being exerted on the center sill member of the railway car during both such make-up and operation of such train consist. It has been found that such maximum reaction pressure is required to enable these high energy shocks to be readily absorbed without upsetting the end of the coupling member shank and/or damaging other critical car components and/or lading that is being transported by such railway car.

In order for the manufacturers of such friction clutch type draft gear assemblies to meet the requirements of the railroad industry, with the ever-increasing load carrying capacity of their modern day railroad cars, it has become of extreme importance to enhance the overall rated capacity of the friction-type draft gear assemblies as much as possible. This higher capacity rating being found necessary in order to minimize any damage to such cars and/or the lading due to the increased forces being exerted on the center sill member of the cars by the heavier loads such cars are now carrying.

SUMMARY OF THE INVENTION

It is therefore an object of the invention to produce a draft gear assembly having an increased capacity and resistance to closure.

It is a further object of the invention to provide a frictional cushioning means for a draft gear assembly wherein an additional side force is applied to the movable plates from the tapered plate.

It is yet a further object of the invention to provide a cushioning means for a draft gear assembly wherein an angle is provided on the portion of the bottom edge of the tapered plate which contacts the third horizontal rib of the housing and/or to the taper plates ear/lug which sits on the third horizontal rib so as to increase the side force on the movable plate, increasing the capacity of the draft gear and providing a greater resistance to closure.

It is an additional object of the invention to provide sufficient clearance between the angled edge surface of the tapered plate and the seat means of the draft gear assembly while accounting for wear of the compressible cushioning element.

Briefly, and in accordance with the forgoing objects, the invention comprises a draft gear assembly comprising a housing closed at one end and open at the opposed end and having a rear portion adjacent the closed end and a front portion adjacent the open end, a compressible cushioning element centrally disposed within the rear portion abutting the housing end and extending longitudinally there from, a seat means abutting the opposite end of the compressible cushioning element during application and release of a force on the draft gear assembly, and a friction cushioning means positioned at least partially within said front portion of said housing for absorbing energy during a compression of said draft gear assembly. The friction cushioning means includes a pair of laterally spaced outer stationary plates having an outer surface for engaging the housing and an opposed inner friction surface, a pair of laterally spaced movable plates having an outer friction surface for movably engaging the outer stationary plates, an inner friction surface and at least one substantially flat edge intermediate said outer friction and inner friction surfaces for engaging the seat means, a pair of laterally spaced tapered plates having an outer friction and an inner friction surface wherein the outer friction surface movably and frictionally engages the inner friction surface of the movable plate, a pair of laterally spaced wedge shoes having an outer friction surface for movably and frictionally engaging an inner friction surface of the tapered plate, and a center wedge having a pair of matching predetermined tapered portions for engaging the tapered portion of the wedge shoe to initiate frictional engagement of said friction cushioning means and thereby absorb energy. The housing includes three horizontal ribs for positioning and/or holding the components of the cushioning means. A spring release means is provided which engages and longitudinally extends between the seat means and the center wedge for continuously urging the friction cushioning means outwardly from the compressible cushioning means to release the friction cushioning element when an applied force compressing the draft gear is removed.

The present invention increases the capacity and resistance to closure of the draft gear assembly by providing an angled bottom surface on the tapered plates intermediate of the inner and outer friction surface in the area where the tapered plate contacts the third horizontal rib of the housing. Providing an angle on the bottom edge surface of the tapered plates and cooperating angled surfaces formed on the build-up portions of the third horizontal rib increases the side force on the movable plates during the application of a buffing shock to the draft gear assembly.

Although a number of objects and advantages of the present invention have been described in some detail above, various additional objects and advantages of the draft gear assembly of the present invention will become more readily apparent to those persons who are skilled in the art from the following more detailed description of the invention, particularly, when such detailed description of the invention is taken in conjunction with both the attached drawing figures and with the appended claims.

DETAILED DESCRIPTION OF THE INVENTION

Figure 1:
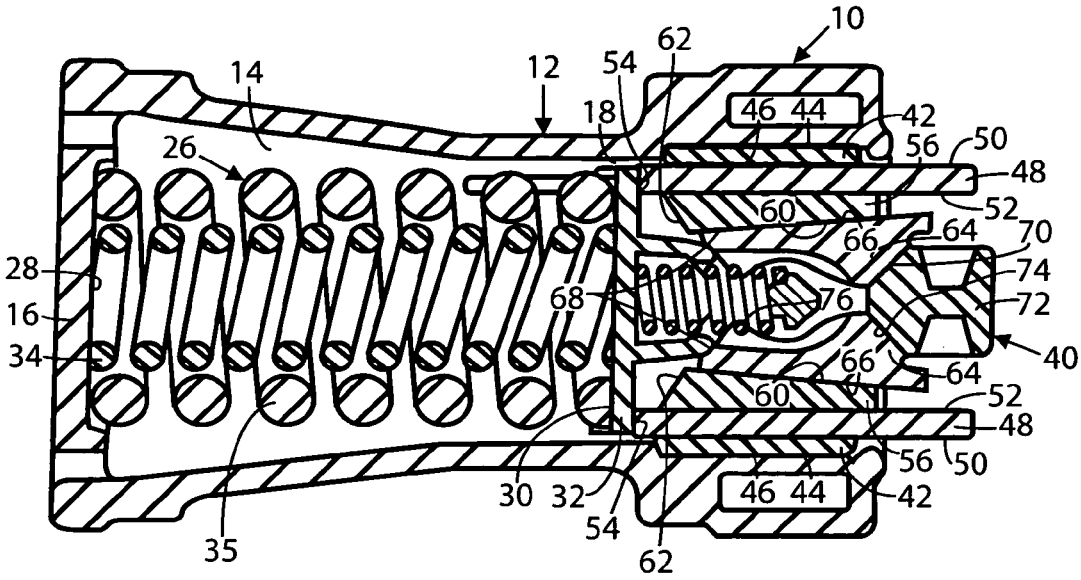
FIG. 1 is a longitudinal cross-sectional view of a draft gear assembly of the invention incorporating one form of a presently preferred embodiment of a cushioning element for the draft gear assembly.

The draft gear assembly, according to the present invention, is installed in alignment with a railroad car center sill between a front and a rear draft gear lug. A vertical yoke is connected to a coupler shank by a draft key with a coupler horn spaced from a striking plate and with a front follower member within the yoke which is positioned adjacent to the front lugs, all substantially in accordance with the prior art conventional practice as illustrated in the aforementioned U.S. Pat. No. 2,916,163 whose teachings are incorporated into this document by reference thereto.

Prior to proceeding to the more detailed description of the various embodiments of the instant invention, it should be pointed out that, for the sake of clarity, identical components which have identical functions have been identified with identical reference numerals throughout the several views that have been illustrated in the drawings.

Figure 2:
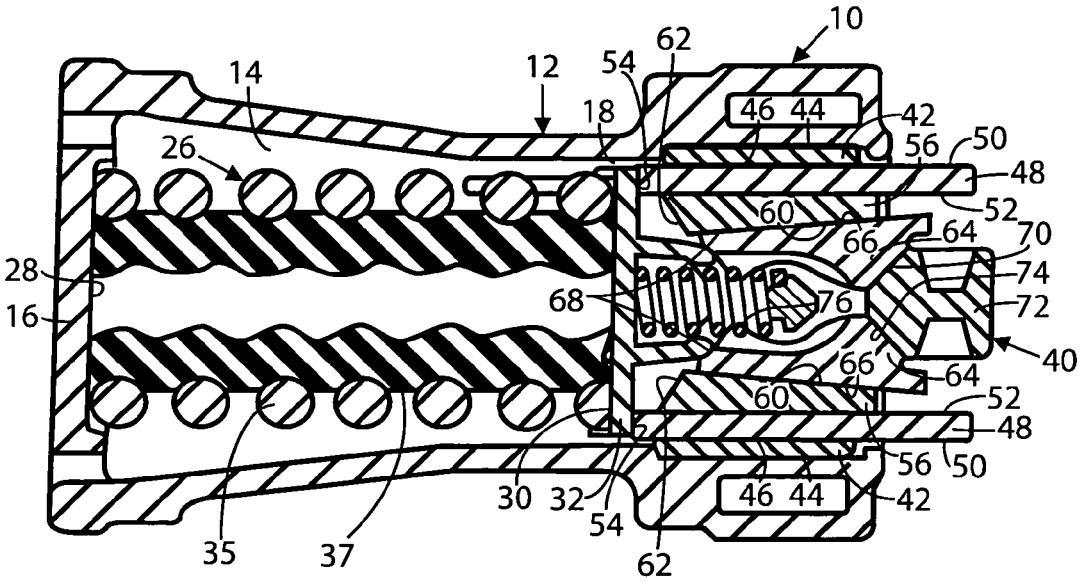
FIG. 2 is a longitudinal cross-sectional view of a draft gear assembly of the invention incorporating an alternative embodiment of a cushioning element for the draft gear assembly.
Figure 3:
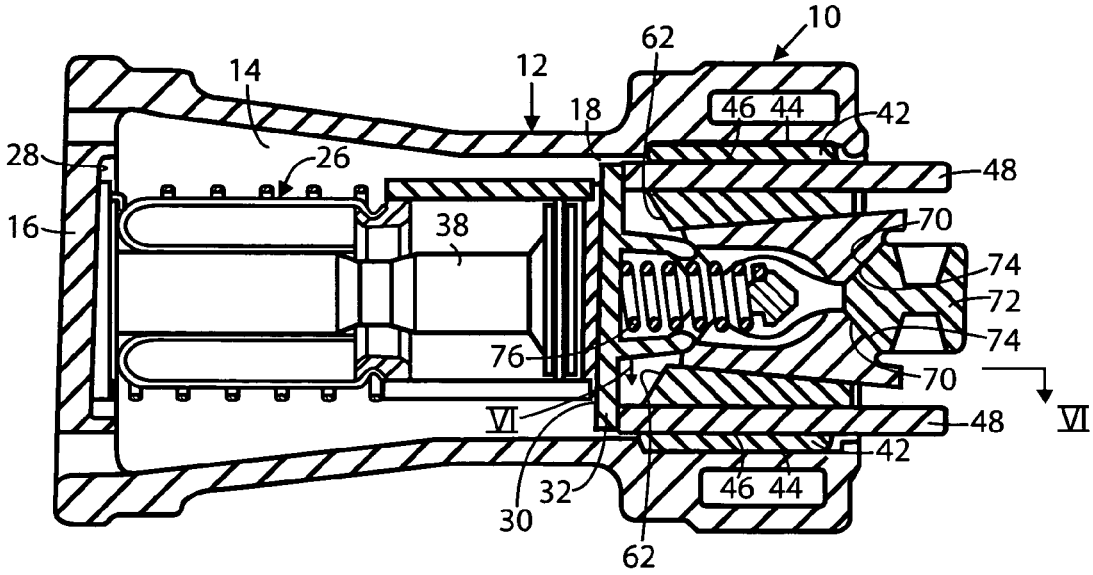
FIG. 3 is a longitudinal cross-sectional view of a draft gear assembly of the invention incorporating an alternative embodiment of a hydraulic cushioning element for the draft gear assembly.
Figure 4:
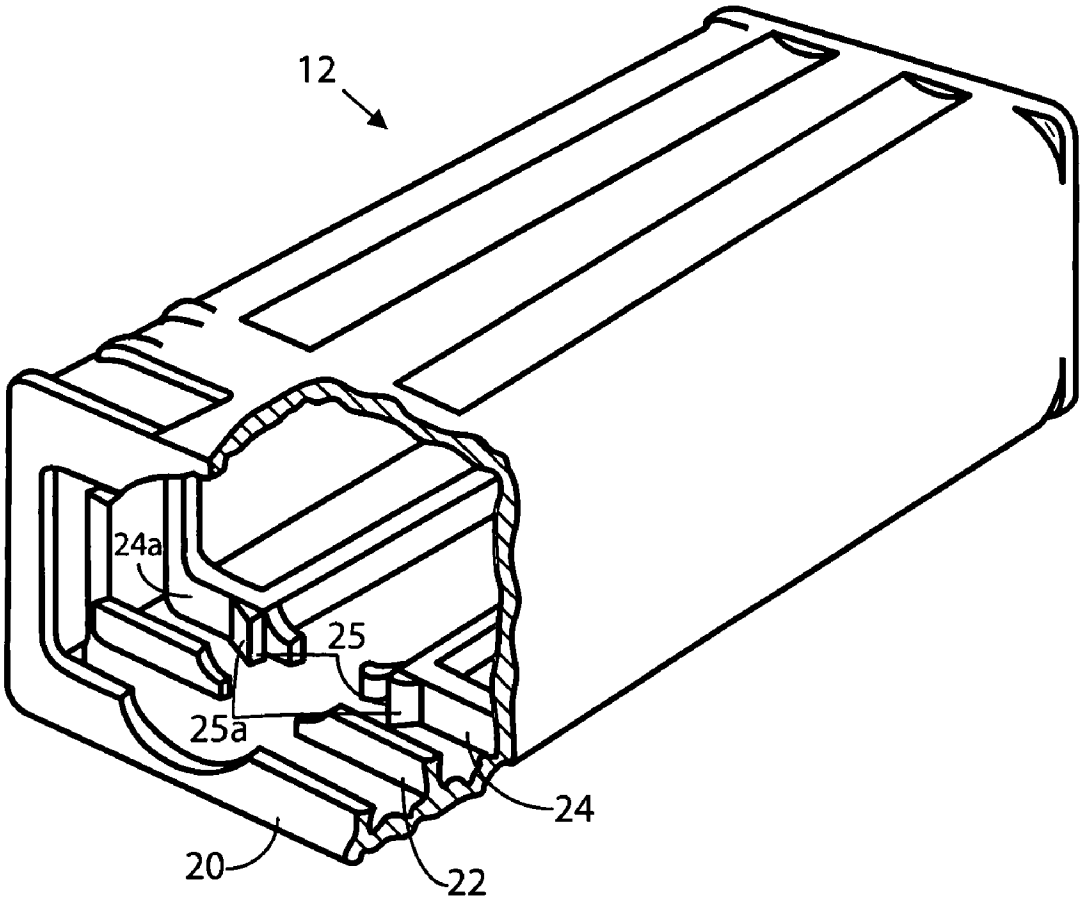
FIG. 4 is a perspective view of the draft gear housing illustrating the first, second, and third horizontal lugs.

Now reference is made, more particularly, to drawing FIGS. 1-4. Illustrated therein are the essential components a draft gear assembly, generally designated 10, used in a railway car (not shown). The assembly 10 includes a housing, generally designated as 12. The housing 12 is open at one end and has a rear portion 14 adjacent a bottom wall 16 which closes the other end of housing 12. Rear portion 14 is provided for receiving therein a compressible cushioning means, generally designated as 26. Housing 12 includes a front portion 18 adjacent the open end. Front portion 18 is in open communication with the rear portion. Housing 12 additionally includes first, second, and third horizontal ribs 20, 22, and 24 as shown in FIG. 4.

The compressible cushioning element 26 is centrally disposed within the rear portion 14 and has one end thereof abutting at least a portion of an inner surface 28 of the bottom wall 16 of housing 12. The compressible cushioning element 26 extends longitudinally from bottom wall 16 where the opposite end is placed into abutting relationship with at least a portion of one surface 30 of a seat means 32. Seat means 32 is positioned within the housing 12 for longitudinal movement therein for respectively compressing and releasing the compressible cushioning element 26 during application and release of a force on the draft gear assembly 10.

As shown in FIG. 1, the compressible cushioning element 26, according to one embodiment of the invention, comprises at least one and preferably at least two springs 34, 35. FIG. 2 shows an alternative embodiment for a compressible cushioning element 26 which comprises an outer coil spring 36 and an inner rubber spring 37. FIG. 3 shows another alternative embodiment of the invention in which the compressible cushioning element 26 is a hydraulic unit 38 such as taught in U.S. Pat. No. 3,447,693 whose teachings are incorporated into this document by reference thereto.

A friction cushioning means, generally designated as 40, is positioned at least partially within the front portion 18 of the housing 12. The friction cushioning means 40 absorbs energy during application of a force sufficient to cause a compression of the draft gear assembly 10.

The friction cushioning means 40 includes a pair of laterally spaced outer stationary plates 42 having an outer surface 44 and an opposed inner friction surface 46. The outer surface 44 engages the housing 12. A pair of laterally spaced movable plates 48 of substantially uniform thickness is also provided. Movable plates 48 have an outer friction surface 50 and an inner friction surface 52 and at least one substantially flat edge 54 intermediate the outer friction surface 50 and the inner friction surface 52 which edge 54 engages the seat means 32. At least a portion of the outer friction surface 50 movably and frictionally engages the inner friction surface 46 of the outer stationary plate 42. A pair of laterally spaced tapered plates 56 is provided. The tapered plates 56 include an outer friction surface 58 and an inner friction surface 60. The outer friction surface 58 movably and frictionally engages at least a portion of the inner friction surface 52 of the movable plate 48.

Each of the tapered plate 56 includes at least one angled or tapered inner edge 62 intermediate the outer friction surface 58 and the inner friction surface 60. Such at least one angled edge 62 is disposed vertically when such draft gear assembly 10 is installed to cushion shocks and is angled at a predetermined angle inwardly from the outer friction surface 58 in a direction toward inner friction surface 60. The predetermined angle of the at least one angled edge 62 may range from approximately 10 to approximately 40 degrees.

Figure 6:
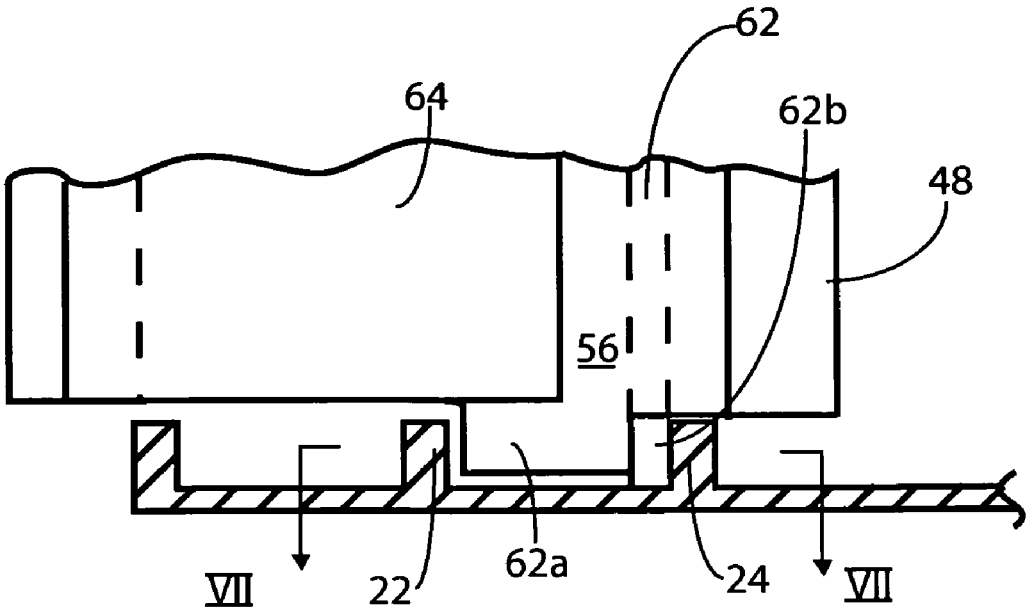
FIG. 6 is a partial elevation view of the draft gear assembly along lines 6-6 of FIG. 3, particularly illustrating an angled surface of the tapered plate and a built-up area of the third horizontal rib of the draft gear housing.
Figure 7:
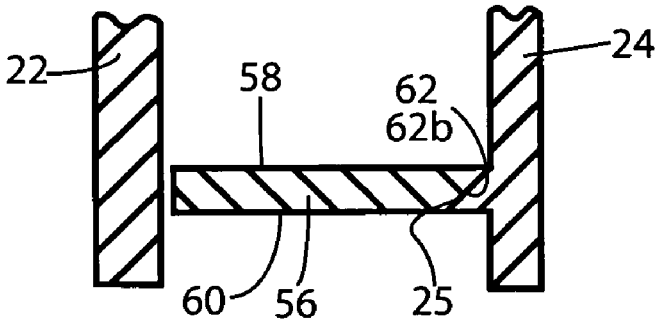
FIG. 7 is a cross-sectional view of the draft gear assembly along lines 7-7 of FIG. 6

Generally, the laterally spaced outer stationary plates 42 and the tapered plates 56 sit on the third horizontal rib 24 of the housing 12. This angled or tapered edge 62 is in the area where the tapered plates 56 contact the third horizontal rib 24, as best shown in FIGS. 6-7. Tapering the area of the tapered plate 56 where the tapered plate 56 sits in the housing 12 requires the area on the front surface 24*a* of the third rib 24 to be built up. Accordingly, pair of build-up areas 25 are disposed in a spaced apart relationship on the front surface 24*a* of such third horizontal rib 24, each of the pair of build-up area 25 having an angled surface 25*a* which is cooperatively angled at an angle of the at least one angled edge 62.

Figure 5:
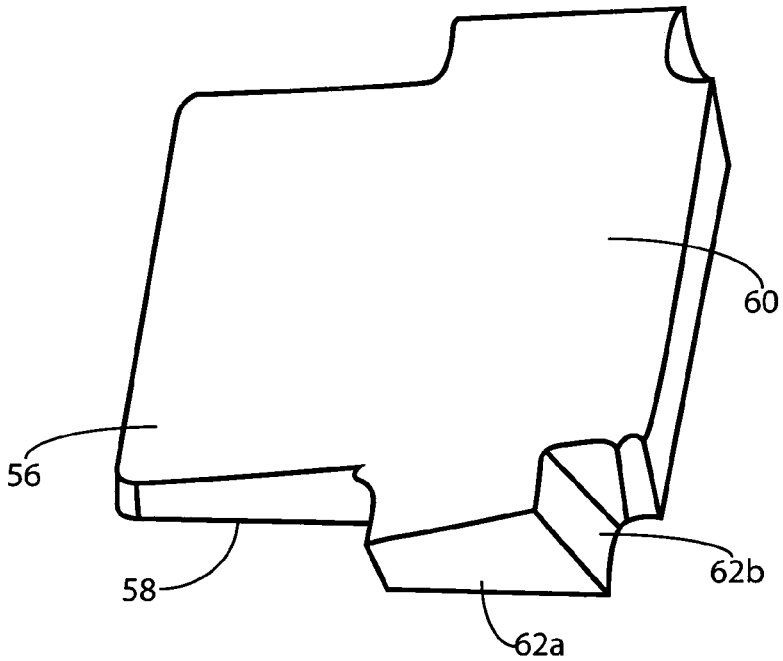
FIG. 5 is a perspective view of a tapered plate which is employed within the draft gear and which is constructed according to one embodiment of the present invention.

When the tapered plate 56 are constructed and positioned within the draft gear housing 12 so that the inner vertical edge is positioned over the third horizontal rib 24, such tapered plate 56 may be provided with a build-up portion 62*a* disposed on the bottom edge thereof, as best shown in FIG. 5, and wherein such build-up portion 62*a* has a vertical angled surface 62*b* which is cooperatively positioned in abutting engagement with the angled surface 25*a* of the build-up area 25 of the third horizontal rib 24. Preferably, the build-up portion 62*a* is formed integral with the tapered plate 56, although it can be secured thereto by any conventional securing means, for example, such as by welding.

Friction cushioning means 40 further includes a pair of laterally spaced wedge shoes 64 which have at least a portion of an outer friction surface 66 movably and frictionally engaging at least a portion of the inner friction surface 60 of the tapered stationary plate 56. Wedge shoes 64 have at least a portion of one edge 68 engaging seat means 32 and a predetermined tapered portion 70 on an opposed edge thereof. A center wedge 72 is provided which has a pair of matching tapered portions 74 for engaging the tapered portion 70 of the wedge shoe 64 to initiate frictional engagement of the friction cushioning means 40.

It has been discovered that providing an angled surface 62, 62*b* on the tapered plates 56 in the area that frictionally contacts the angled surface 25*a* of the build-up portion 25 of the third horizontal rib 24 of the housing 12, results in a greater side force being applied to movable plates 56. Thus, the capacity of the draft gear and its resistance to closure is increased. A spring release means 76 engages and extends longitudinally between the seat means 32 and the center wedge 72 for continuously urging the friction cushioning means 40 outwardly from the compressible cushioning means 26 to release the friction cushioning means 40 when an applied force compressing the draft gear assembly 10 is removed.

A draft gear typically has approximately 0.125" clearance between the bottom edges of the taper plates 56 and the seat means 32. High loading from the taper plate requires that the housing's bearing area and the cross-sectional area on the taper plate's ear remain equal to the present design so shear failures do not occur. As the draft gear wears out, the assembled height of the spring type compressible cushioning elements 26 of FIGS. 1 and 2 increases, resulting in a reduced clearance between the bottom edges of the taper plates 56 and the seat means 32. A draft gear nearly worn out has near zero clearance between the bottom edges of the taper plates 56 and the seat means 32. The present invention's new design criteria and assembly conditions are as follows:

For a 10 degree taper, approximately 0.176" of clearance is provided.

For a 20 degree taper, approximately 0.364" of clearance is provided.

For a 30 degree taper, approximately 0.5571" of clearance is provided.

For a 40 degree taper, approximately 0.839" of clearance is provided.

In operation, the buffing shock is transmitted from the coupler through the front follower to the central wedge 72, causing it to act through the wedge shoes 64 and thereby compress all of the cushioning elements simultaneously. These parts will furnish sufficient cushioning for light buffing shocks. After suitable travel, however, the follower will come against the outer ends of the movable plates 48 introducing energy-absorbing friction between the movable plates 48 and the stationary plates 42 and 56 which have been pressed together by the action of the wedge shoes 64. As this action continues, the pressure between the adjacent surfaces of the plates has been enormously increased due to the fact that the wedge shoes 64 are loaded against the cushioning mechanism 40.

The energy absorption and dissipation through friction and compression of the cushioning mechanism continues until the gear is closed including compression of cushioning element 26.

During release of the gear, the compressible cushioning element 26 is maintained in alignment by the seat means 32.

Although, the present invention has been illustrated in terms of having a build-up area 25 on the third horizontal rib 24, it would be apparent to one of ordinary skill in the art that such build-up area 25 may be formed on other horizontal ribs, for example a second horizontal rib 22, particularly, when the draft gear assembly 10 uses the tapered plate 56 of FIG. 5.

Thus, the present invention has been described in such full, clear, concise and exact terms as to enable any person skilled in the art to which it pertains to make and use the same. It will be understood that variations, modifications, equivalents, and substitutions for components of the specifically described embodiments of the invention may be made by those skilled in the art without departing from the spirit and scope of the invention as set forth in the appended claims.

We claim:

1. A draft gear assembly having an increased capacity to cushion shocks encountered in railroad rolling stock, said draft gear assembly comprising:

(a) a housing closed at one end and open at an opposed end, said housing having a rear portion adjacent said closed end, a front portion adjacent said open end, said front portion being in open communication with said rear portion, and at least one horizontal rib having a front surface and an opposed rear surface;

(b) a pair of build-up areas disposed in a spaced apart relationship on said front surface of said at least one horizontal rib, each of said pair of build-up areas having a first angled surface;

(c) a compressible cushioning element centrally disposed within said rear portion with one end thereof abutting at least a portion of an inner surface of said closed end of said housing, said compressible cushioning element extending longitudinally from said one end;

(d) a seat means having at least a portion of one surface thereof abutting the opposite end of said compressible cushioning element during application and release of a force on said draft gear assembly;

(e) a friction cushioning means positioned at least partially within said front portion of said housing for absorbing energy during a compression of said draft gear assembly, said friction cushioning means including (i) a pair of laterally-spaced movable plates having an outer friction surface and an inner friction surface and at least one substantially flat edge intermediate said outer friction and inner friction surfaces, said one edge engaging said seat means, (ii) a pair of laterally spaced tapered plates each positioned for frictional engagement with at least a portion of said inner friction surface of a respective one of said pair of movable plates, said tapered plates having an outer friction and an inner friction surface and at least one edge intermediate said outer friction and inner friction surfaces, (iii) a second angled surface disposed on at least a portion of said at least one edge of said each tapered plate and abuttingly engaging a respective first angled surface of said pair of build-up areas of said at least one horizontal rib, said second angled surface being capable of increasing a side force applied to said movable plates and increasing the capacity of said draft gear, (iv) a pair of laterally spaced wedge shoes having at least a portion of an outer friction surface movably and frictionally engaging at least a portion of an inner friction surface of said tapered plate, and at least a portion of one edge engaging said seat means, and (v) a center wedge having a pair of matching predetermined tapered portions for engaging said tapered portion of said wedge shoe to initiate frictional engagement of said friction cushioning means and thereby absorb energy to cushion shocks encountered in railroad rolling stock.

2. A draft gear assembly having an increased capacity as recited in claim 1 wherein said housing includes a first, second, and third horizontal rib and wherein said build-up areas are formed on said third horizontal rib.

3. A draft gear assembly having an increased capacity as recited in claim 1 wherein an angle of said first angled surface of said tapered plate is approximately 10-40 degrees.

4. A draft gear assembly having an increased capacity as recited in claim 3 wherein a clearance of approximately 0.176-0.839 inches is provided between said seat means and said at least one edge of said tapered plate.

5. A draft gear assembly having an increased capacity as recited in claim 1 wherein said cushioning means includes a pair of laterally spaced outer stationary plates having an outer surface for engaging said housing and an opposed inner friction surface for engaging said outer friction surface of said movable plates.

6. A draft gear assembly having an increased capacity as recited in claim 1 including a spring release means engaging and longitudinally extending between said seat means and said center wedge for continuously urging said friction cushioning means outwardly from said compressible cushioning means to release said friction cushioning element when an applied force compressing said draft gear is removed.

7. A friction cushioning means for a draft gear assembly to cushion shocks encountered in railroad rolling stock, said friction cushioning means comprising:

(a) a pair of laterally spaced outer stationary plates having an outer surface for engaging a housing of said draft gear assembly and an opposed inner friction surface;

(b) a pair of laterally spaced movable plates having an outer friction surface and an inner friction surface, at least a portion of said outer friction surface movably and frictionally engaging said inner friction surface of said outer stationary plate;

(c) a pair of laterally spaced tapered plates, each having an outer friction surface and an inner friction surface, said outer friction surface movably and frictionally engaging at least a portion of said inner friction surface of a respective one of said pair of movable plates, said each tapered plate further having an angled edge intermediate said outer friction and inner friction surfaces, said angled edge is angled at a predetermined angle inwardly from said outer friction surface in a direction toward said inner friction surface, said angled edge is disposed generally vertically when the draft gear assembly is installed to cushion shocks;

(d) a pair of laterally spaced wedge shoes having at least a portion of an outer friction surface movably and frictionally engaging at least a portion of an inner friction surface of said tapered plate, and at least a portion of one edge engaging said seat means;

(e) a center wedge having a pair of matching predetermined tapered portions for engaging said tapered portion of said wedge shoe to initiate frictional engagement of said friction cushioning means and thereby absorb energy to cushion shocks encountered in railroad rolling stock;

(f) a built-up portion disposed on an edge of said each tapered plate, said built-up portion having an inner surface thereof being common with said inner friction surface of said each tapered plate, an outer surface thereof being common with said outer friction surface of said each tapered plate and an end surface angled at a predetermined angle from said outer surface of said built-up portion in a direction toward said inner surface of said built-up portion, said angled end surface disposed generally vertically when such draft gear assembly is installed to cushion shocks; and (g) wherein said friction cushioning means is positioned in a housing and wherein said housing includes a first, second, and third horizontal rib, said third horizontal rib disposed inwardly from first and second ribs and having a built-up area with an angled surface, and said angled end surface of said built-up portion of said each tapered plate is positioned in abutting engagement on said angled surface of said third horizontal rib.

8. A friction cushioning means for a draft gear assembly as recited in claim 7 wherein said predetermined angle of said intermediate angled edge of said tapered plate is approximately 10-40 degrees.

9. A friction cushioning means for a draft gear assembly as recited in claim 8 wherein a seat means is provided beneath said intermediate angled edge and a clearance of approximately 0.176-0.839 inches is provided between said seat means and said intermediate angled edge of said tapered plate.

10. A friction cushioning means for increasing the capacity of a draft gear assembly to cushion shocks encountered in railroad rolling stock, said friction cushioning means comprising:

(a) a pair of laterally spaced movable plates having an outer friction surface and an inner friction surface;

(b) a pair of laterally spaced tapered plates, each having an outer friction surface and an inner friction surface;

(c) a pair of laterally spaced wedge shoes having at least a portion of an outer friction surface movably and frictionally engaging at least a portion of an inner friction surface of said tapered plate, and at least a portion of one edge engaging a seat means disposed within said draft gear assembly; and (d) a center wedge having a pair of matching predetermined tapered portions for engaging tapered portions of a wedge shoes to initiate frictional engagement of said friction cushioning means and thereby absorb energy to cushion shocks encountered in railroad rolling stock;

(e) a built-up portion disposed on an edge of said each tapered plate, said built-up portion having an inner surface thereof being common with said inner friction surface of said each tapered plate, an outer surface thereof being common with said outer friction surface of said each tapered plate and an end surface angled at a predetermined angle from said outer surface of said built-up portion in a direction toward said inner surface of said built-up portion, said angled end surface disposed generally vertically when such draft gear assembly is installed to cushion shocks; and (g) wherein said friction cushioning means is positioned in a housing and wherein said housing includes a first, second, and third horizontal rib, said third horizontal rib disposed inwardly from first and second ribs and having a built-up area with an angled surface, and wherein said angled end surface of said built-up portion of said each tapered plate is positioned in abutting engagement on said angled surface of said third horizontal rib.

11. A friction cushioning means for a draft gear assembly as recited in claim 10 wherein said tapered plate further includes an angled edge intermediate said outer friction and inner friction surfaces, said angled edge is angled at a predetermined angle inwardly from said outer friction surface in a direction toward said inner friction surface, said angled edge is disposed generally vertically when such draft gear assembly is installed to cushion shocks.

12. A friction cushioning means for increasing the capacity of a draft gear assembly as recited in claim 11 wherein said predetermined angle of said intermediate angled edge of said each tapered plate is approximately 10-40 degrees.

13. A friction cushioning means for increasing the capacity of a draft gear assembly as recited in claim 12 wherein a seat means is provided beneath said intermediate angled edge and clearance of approximately 0.176-0.839 inches is provided between said seat means and said intermediate angled edge of said each tapered plate.

14. A friction cushioning means for increasing the capacity of a draft gear assembly as recited in claim 10 wherein said cushioning means includes a pair of laterally spaced outer stationary plates having an outer surface for engaging said housing and an opposed inner friction surface for engaging said outer friction surface of said movable plates.

15. A friction cushioning means for increasing the capacity of a draft gear assembly as recited in claim 10 including a spring release means engaging and longitudinally extending between a seat means and said center wedge for continuously urging said friction cushioning means outwardly from said compressible cushioning means to release said friction cushioning element when an applied force compressing said draft gear is removed.

* * * * *